US007438016B2

(12) United States Patent
Dronne et al.

(10) Patent No.: US 7,438,016 B2
(45) Date of Patent: Oct. 21, 2008

(54) METHOD AND DEVICE FOR LAUNCHING INTO THE WATER A MEANS FOR LIFE-SAVING AT SEA FROM A HEIGHT GREATER THAN ITS MAXIMUM LAUNCH HEIGHT

(75) Inventors: Cédric Dronne, Jonzac (FR); Pascal Michaud, Chevanceaux (FR); Guillaume Simon-Bouhet, Chevanceaux (FR); Marc Lavorata, Paris (FR)

(73) Assignee: Zodiac International (FR)

( * ) Notice: Subject to any disclaimer, the term of this patent is extended or adjusted under 35 U.S.C. 154(b) by 0 days.

(21) Appl. No.: 11/481,325

(22) Filed: Jul. 5, 2006

(65) Prior Publication Data

US 2007/0006790 A1 Jan. 11, 2007

(30) Foreign Application Priority Data

Jul. 6, 2005 (FR) ..... 05 07212

(51) Int. Cl.
*B63B 23/28* (2006.01)
*B63B 32/30* (2006.01)

(52) U.S. Cl. ..... 114/365; 114/375; 114/378

(58) Field of Classification Search ..... 441/42; 114/365, 366, 368, 375, 377, 378, 379; 182/241, 182/5, 6, 7

See application file for complete search history.

(56) References Cited

U.S. PATENT DOCUMENTS

| | | | | |
|---|---|---|---|---|
| 3,507,417 | A * | 4/1970 | Crompton et al. | 220/4.21 |
| 4,187,570 | A | 2/1980 | DeSimone | |
| 4,311,218 | A * | 1/1982 | Steffen | 188/65.4 |
| 4,550,801 | A | 11/1985 | Forrest | |
| 5,619,951 | A | 4/1997 | Constantinis | |

FOREIGN PATENT DOCUMENTS

| | | | |
|---|---|---|---|
| GB | 2 092 103 | A * | 11/1982 |
| GB | 2106858 | | 4/1983 |
| GB | 225533 | | 11/1992 |

* cited by examiner

*Primary Examiner*—Sherman Basinger
(74) *Attorney, Agent, or Firm*—Dean W. Russell; Kilpatrick Stockton LLP

(57) ABSTRACT

The invention relates to methods and devices for launching into the water, from a height H greater than a predetermined height $h_{max}$, a life-saving object designed to be able to be launched into the water in free fall from this maximum height $h_{max}$. One end of a halyard is fixedly hooked to the life-saving object or to the launch site; the halyard functionally cooperates respectively with the launch site or the life-saving object so that the life-saving object falling by gravity is braked on and/or by the halyard over at least one part ($H-h_{max}$) of its drop height. By controlling the braking effect, the life-saving object, falling from the height H in a braked manner over at least one part ($H-h_{max}$) of this height hits the surface of the water (5) with a kinetic energy not exceeding that which it would have at the end of a non-braked free fall from at most the height $h_{max}$.

12 Claims, 7 Drawing Sheets

METHOD AND DEVICE FOR LAUNCHING INTO THE WATER A MEANS FOR LIFE-SAVING AT SEA FROM A HEIGHT GREATER THAN ITS MAXIMUM LAUNCH HEIGHT

CROSS-REFERENCE TO RELATED APPLICATION

This application claims priority to French Patent Application No. FR 05 07212 filed Jul. 6, 2005, the contents of which are incorporated herein by reference.

FIELD OF THE INVENTION

The present invention generally relates to the field of life-saving at sea and, more specifically, it relates to improvements made in the process of launching into the water a means for life-saving at sea.

BACKGROUND OF THE INVENTION

Within the context of the present invention, 'means for life-saving' is understood to designate any means provided for rescue, life-saving and survival at sea which is able to be launched into the water, such as in particular rescue boats, lifeboats and, most particularly, containers containing an inflatable life raft in the uninflated and folded state or any other similar device (for example, a rescue platform) designed to be implemented by being launched into the water within the context of life-saving at sea.

The means for life-saving or survival at sea are usually fitted in ships or fixed installations such as offshore platforms, for example for oil drilling. The means for life-saving or survival are often arranged at significant heights above the water, for example on an evacuation deck able to be located at a height of 20 metres or more on ships, or at even greater heights, of 30 or 40 metres, even 50 metres, on fixed platforms.

The means for life-saving or survival, whatever their type: rigid (such as a boat) or pneumatically inflatable, contained in a container and which are designed to be launched into the water, have to be launched without damaging the structure itself or the equipment with which they are fitted.

The greater the drop height and the greater their weight, the more violent their impact with the water, which for large drop heights, results in substantial reinforcement of the life-saving means with regard to its mechanical resistance to impact, solely from the point of view of its launch into the water.

This is the case, in particular, for inflatable life rafts of relatively large capacity (for example 25 to 50 people) or large, even very large, capacity (for example 80, 100 or 150 people), which are, in particular, fitted to passenger-carrying ships (liners, car ferries) and which are contained in the uninflated and folded state with their equipment in a rigid, mechanically resistant container, for example of generally cylindrical shape, which is stowed on a deck of the ship. A container containing a large capacity raft (several dozen people) weighs several hundred kilos (and even considerably exceeds a tone for very large capacity rafts of 100-150 people).

At the moment of impact of the container with the water, the violence of the impact may cause delamination of the layers of fiberglass and/or break-up of the constituent resin of the shell of the container, even the rupture of the shell of the container. This deterioration leads to the formation of sharp fragments and sharp edges capable of piercing the flexible wall of the float of the raft during the inflation thereof.

This has led manufacturers to produce containers which have even greater reinforcement (and are therefore even heavier) by increasing the fiberglass and resin layers, the greater the anticipated launch height, and to define a maximum launch height (or nominal launch height) which the container has to be able to resist without damage.

As the increased mechanical resistance of the container is translated into a significant increase in cost, users generally wish to use containers approved only for a drop height which is strictly necessary, for optimum reduction in the cost of fitting out ships. These requirements lead manufacturers to increase the number of types of container approved for various launch heights, which poses problems for manufacture and the stocking of parts, and even maintenance. All things considered, increasing the number of different types of container does not allow their cost price to be reduced as much as would be desirable.

There is therefore a constant demand on the part of manufacturers and users and ship owners, for a greater standardization of containers for life rafts and more generally for a reduction in weight of all life-saving means whatever the type, whilst respecting the restrictions to the speed with which they come into contact with the water when they are launched, in order to avoid damage thereto.

SUMMARY OF THE INVENTION

The object of the invention is specifically to meet these expectations and to propose improved means (method and device) allowing the aforementioned drawbacks to be avoided.

To these ends, according to the first of its features, the invention proposes a method for launching into the water, from a height H greater than a predetermined height $h_{max}$ (approved height), a life-saving means which is designed to be able to be launched into the water in free fall from said maximum height $h_{max}$, wherein according to the invention at least one halyard is fixedly hooked by one of its ends to the life-saving means or to the launch site and wherein the halyard functionally cooperates respectively with the launch site located at said height H or the life-saving means, so that the life-saving means falling by gravity is braked on and/or by the halyard over at least one part ($H-h_{max}$) of this drop height.

Thus, by controlling the braking effect, it is possible that the life-saving means falling from the height H in a braked manner over at least one part ($H-h_{max}$) of this height, hits the surface of the water with a kinetic energy not exceeding that which it would have at the end of a non-braked free fall from at most the height $h_{max}$.

According to a possible embodiment of the method of the invention, the length of the halyard is at least equal to said height H, the life-saving means now falling by being braked over its entire drop height H.

According to a further possible embodiment of the method of the invention, the length of the halyard is less than the height H, but at least equal to ($H-h_{max}$), the life-saving means now falling while being braked over the entire length of the halyard, then finishing by falling in free fall over a height not exceeding $h_{max}$.

In a possible embodiment, to create said functional cooperation, a woven or sewn or stitched halyard is used, for example in the form of a tubular strap or two sewn straps, having transverse calibrated rupture threads; the successive and progressive rupture of these transverse threads, by means of a rupture member displaced relative to the halyard under the action of the weight of the life-saving means, produces the braking effect.

Further solutions may also be conceived, such as the engagement of the halyard through a multiplicity of calibrated passages arranged so as to create a winding trajectory which generates friction, producing the braking.

The practical implementation of these arrangements may give rise to different variants, depending on whether it is the lower end of the halyard which is fixedly attached to the life-saving means and the halyard functionally cooperates with the launch site or it is the upper end of the halyard which is fixedly attached to the launch site and the halyard functionally cooperates with the life-saving means.

Nevertheless, a further possible embodiment of the method of the invention, which is currently preferred by the applicant, consists in that a halyard formed from at least two straps sewn or stitched to one another by calibrated rupture threads is used, in that the respective ends of these two straps belonging to the same end of the halyard are fixedly attached to the launch site and/or to the life-saving means and in that these calibrated rupture threads are successively and progressively broken as the life-saving means falls: the rupture of the threads due to the force of separation applied to the straps by the weight of the life-saving means produces the braking effect.

The method according to the invention perfectly meets the respective desires of users and ship owners and manufacturers of life rafts, in particular, since a life-saving means, in particular a container containing an inflatable raft, approved for a given launch height $h_{max}$ may now be dropped from a substantially greater height H without it being necessary to reinforce the life-saving means mechanically and/or to apply a new approval procedure. In particular, it is possible to conceive a simplification in the range of life rafts, an improved standardization in the equipment of ships with life rafts and as a result, substantial cost savings.

Finally, it will be emphasized that the method of the invention does not lead to significant modifications to the life-saving means and the launch sites. It is therefore perfectly conceivable, according to the invention, to equip not only new ships or platforms but also to retrofit preexisting ships or platforms at low cost by modifying the existing equipment.

According to the second of its features and in order to implement the method explained above, the invention now proposes a device allowing a life-saving means which is designed to be able to be launched into the water in free fall from said maximum height $h_{max}$, to be launched into the water from a height H greater than a predetermined height $h_{max}$, this device comprising:

at least one halyard capable of being fixedly hooked to the life-saving means or to the launch site located at said height H, and connecting means capable of functionally connecting said halyard respectively to said launch site or to said life-saving means such that when the life-saving means is released from the launch site and falls under the action of gravity, it is braked on and/or by means of the halyard over at least one part ($H-h_{max}$) of its drop height, whereby the life-saving means finally hits the surface of the water with a kinetic energy which does not exceed that which it would have at the end of a free fall from a height of at most $h_{max}$.

According to a first possible embodiment, the length of the halyard may be at least equal to the height H, whereby the life-saving means falls whilst being braked over its entire length of fall H.

According to a second possible embodiment, the length of the halyard may be less than the height H, but at least equal to ($H-h_{max}$), whereby the life-saving means firstly falls whilst being braked over the entire length of the halyard, then finishes by falling in free fall over a height not exceeding $h_{max}$.

In a possible embodiment, to form the above connecting means, the halyard is a woven or sewn or stitched halyard, for example in the form of a tubular strap or two straps sewn to one another, with transverse calibrated rupture threads, whereby it is the successive rupture of these transverse threads under the action of a rupture member in relative displacement relative to the halyard under the action of the weight of the life-saving means which produces the braking effect.

Further embodiments are conceivable such as a multiplicity of members with calibrated passages defining a winding trajectory for the halyard, generating the friction causing the braking effect.

The exploitation of said arrangements may consist in that the lower end of the halyard is fixedly attached to the life-saving means and in that said connecting means functionally connect the halyard to the launch site, or as a variant, the upper end of the halyard is fixedly attached to the launch site and said connecting means functionally connect the halyard to the life-saving means.

Nevertheless, a further embodiment which is currently preferred by the applicant consists in that the halyard comprises at least two straps sewn or stitched to one another by calibrated rupture threads, whereby it is the successive and progressive rupture of these sewn or stitched threads under the action of the weight of the life-saving means which produces the braking effect. Advantageously, therefore, the two respective ends of the two straps separated from one another are engaged through two guides (constituted, for example, in the form of two chain plates fixed to the container), remote from one another, of the life-saving means and are fixedly hooked to the launch site. Thus, the two straps are pulled in opposite directions to one another under the action of the weight of the life-saving means, producing the successive and progressive rupture of the sewn or stitched threads.

Due to the means proposed by the invention, the equipping of ships or fixed installations, which may be fitted with the same life-saving means whatever the stowage and launch heights thereof, is simplified and constraints of use which are inherent in the height $h_{max}$ are overcome by having the facility to install the container at a height H greater than the approved height $h_{max}$; furthermore, more particularly for that which concerns life rafts contained in rigid containers, mass production of larger containers is therefore possible as a result, with a significant reduction in costs. It will also be emphasized, as it refers here to a very important feature of the invention, that the braking of the life-saving means during its fall is obtained independently and without external intervention from the moment when the life-saving means is dropped: it is therefore not necessary to provide any additional procedure, or any additional member to be operated or released and the work of the crew members strictly remains the same as that which it is currently.

BRIEF DESCRIPTION OF THE DRAWINGS

The invention will be better understood by reading the detailed description which follows of certain preferred embodiments given solely by way of non-limiting example. In this description, reference will be made to the accompanying drawings, in which.

DETAILED DESCRIPTION OF THE INVENTION

In the description which follows, for reasons of simplification and clarity and because it refers here to a most particularly interesting application of the arrangements of the invention, reference will be more particularly made, as a life-saving means, to a container containing an uninflated and folded inflatable life raft, it being understood that the invention relates more generally to any rigid life-saving means (lifeboat, rescue boat, etc.) or inflatable life-saving means (raft, rescue platform, etc.) suitable for being put into the water by launching from a launch site (deck of a ship, offshore platform, etc.).

Figure 1A:
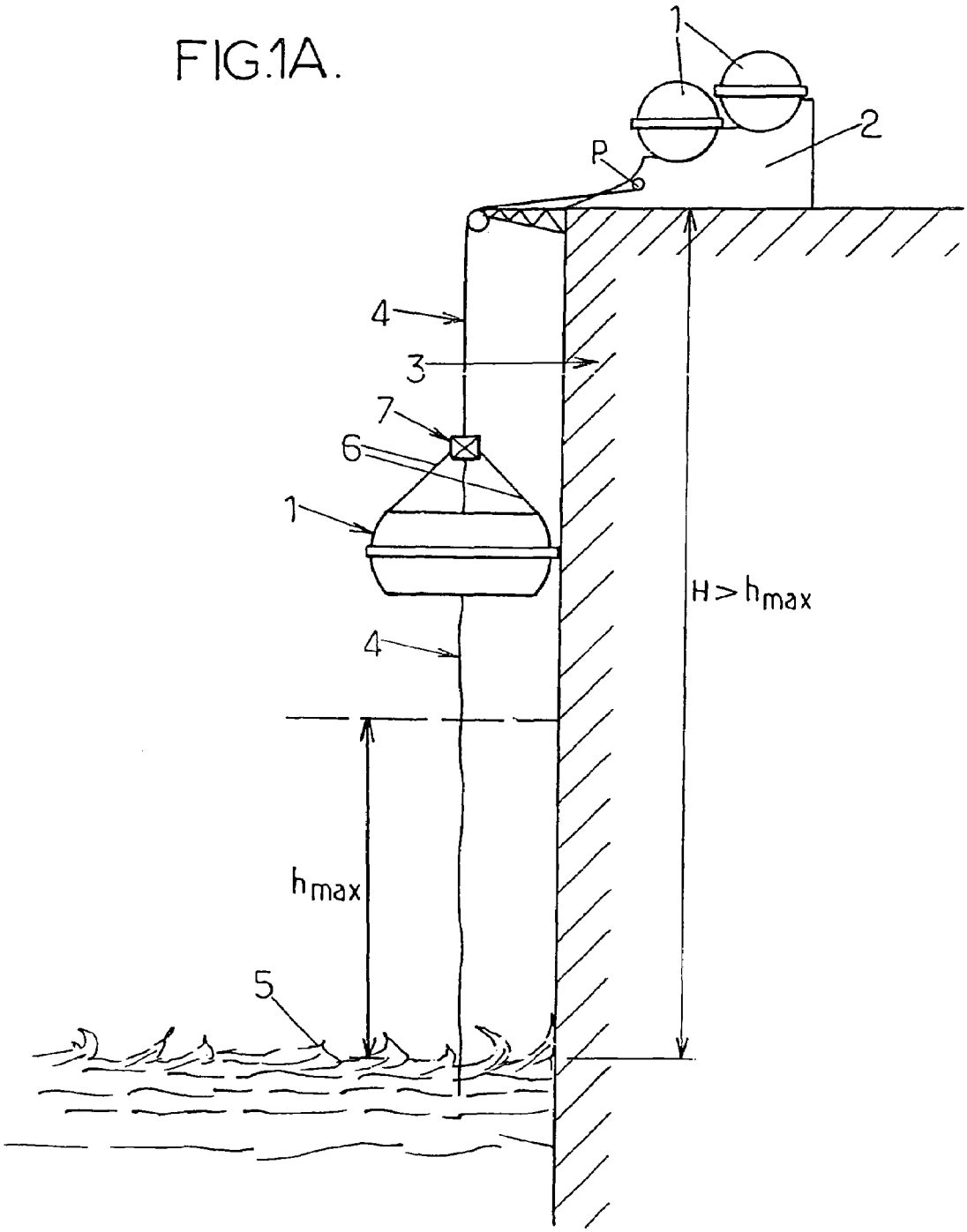
FIGS. 1A and 1B are in principle very schematic representations respectively of a first and a second variant of a possible embodiment of the arrangements of the invention.
Figure 1B:
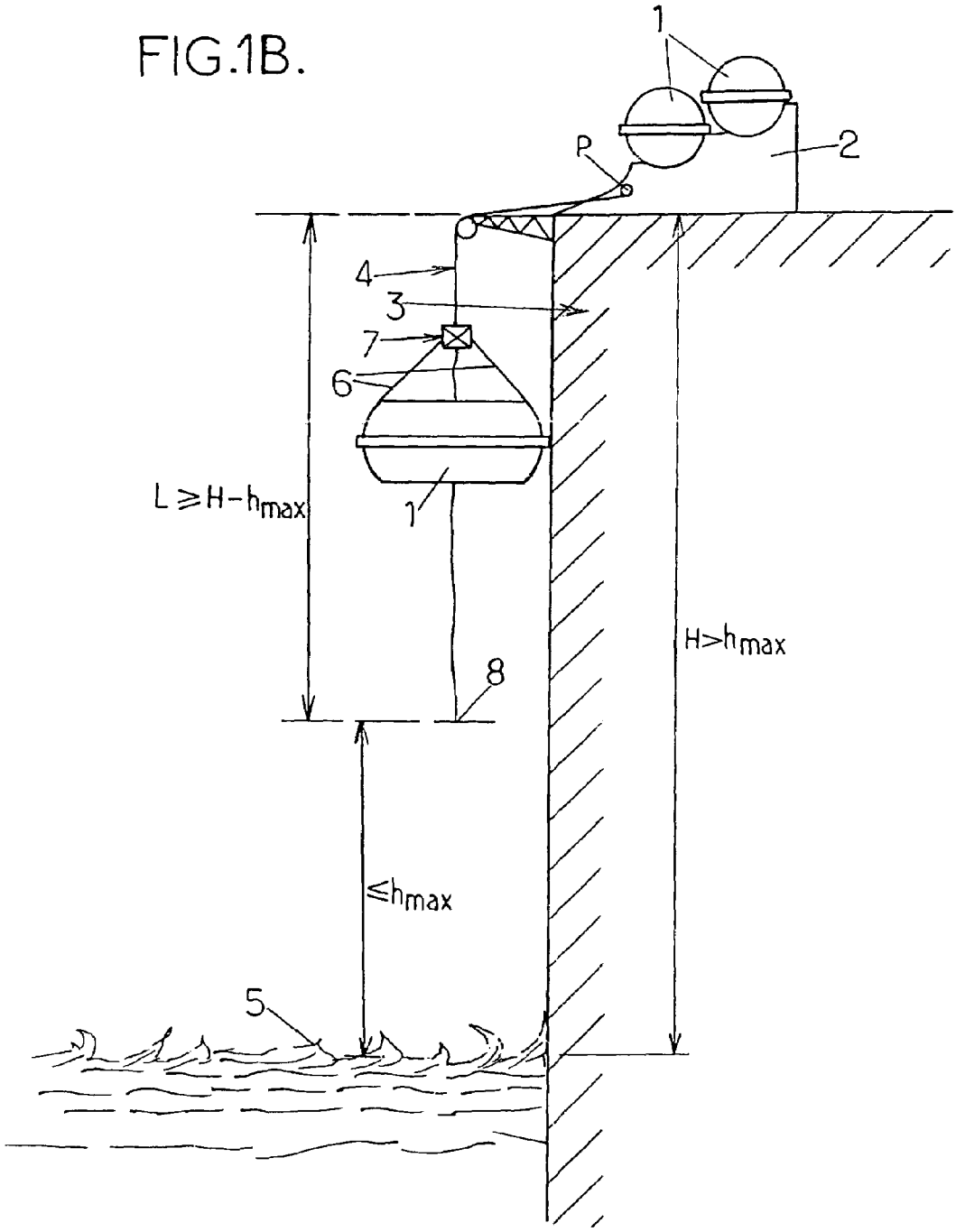
Figure 2:
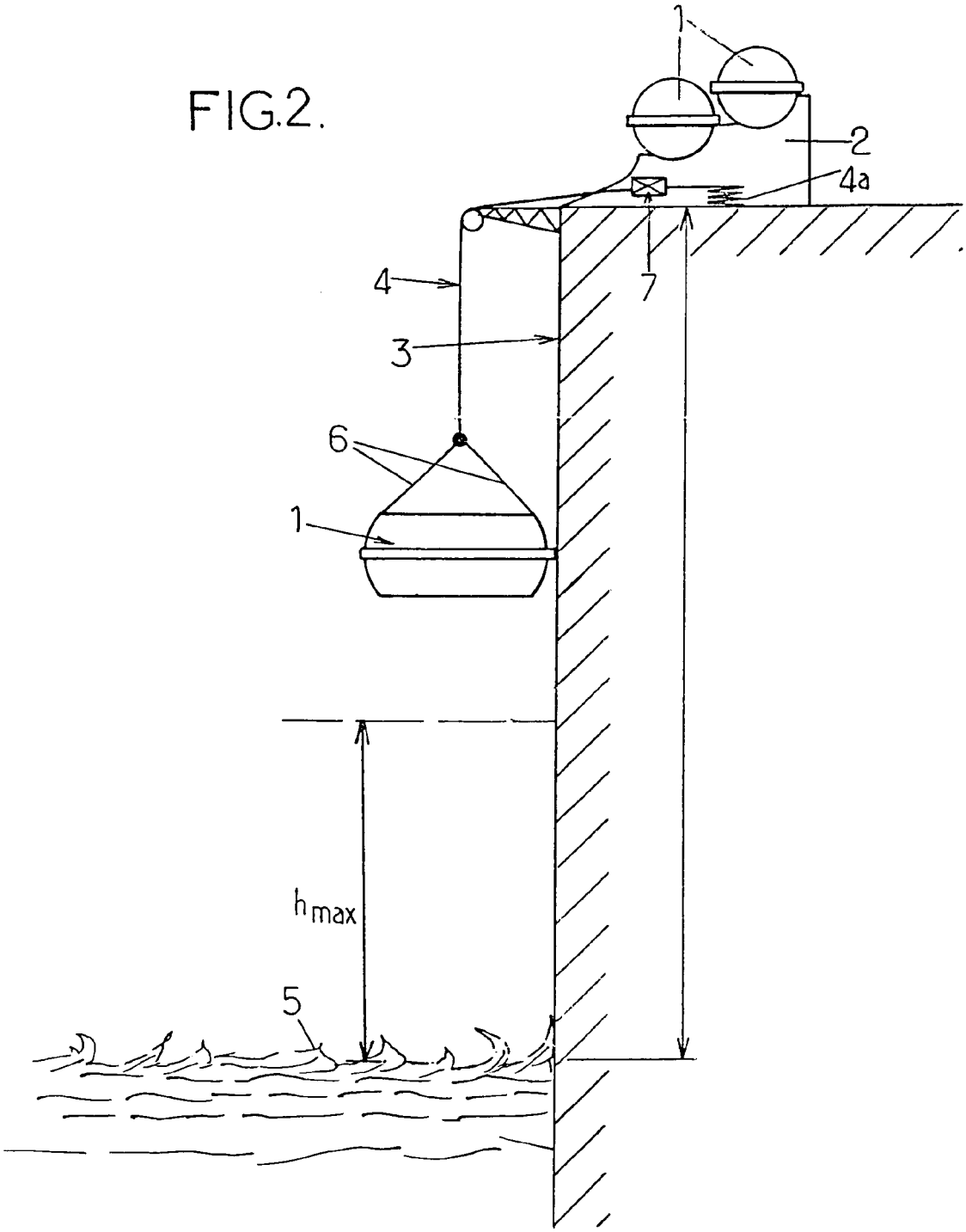
FIG. 2 is in principle a very schematic representation of a further possible embodiment of the arrangements of the invention.

By referring now firstly to FIGS. 1A, 1B and 2, at least one container 1 containing an uninflated and folded inflatable life raft, with its equipment, is stowed on a deck of a ship 3 (or any other installation extending above the water, for example a fixed installation such as an oil rig). In the examples shown in FIGS. 1A, 1B and 2, the container 1 (shown during its fall) is shown as having been stowed on a cradle 2 (which may possibly carry other containers 1) which cradle 2 therefore constitutes the aforementioned launch site (which itself will also be designated hereinafter by the reference numeral 2).

The stowage point of the container 1 is located at a height H above the water 5, whilst the container is mechanically designed and approved to be able to be launched into the water from a maximum height or nominal height $h_{max}$ which is lower than the stowage height H.

According to the invention, at least one halyard 4 is provided, fixedly hooked at one of its ends to the container 1 or to the launch site of the container 1.

Moreover, the halyard 4 functionally cooperates (at 7) respectively with the launch site or the container 1 so that the container 1 falling by gravity under the action of its own weight (several hundred kilos, or even in the order of a tonne) is braked on and/or by the halyard 4 over at least one part ($H-h_{max}$) of its drop height.

Due to these arrangements according to the invention, by regulating the braking effect due to the functional cooperation of the halyard with the launch site or the container, it is possible that the container 1 falling from the height H in a braked manner over at least one part ($H-h_{max}$) of this height, hits the surface of the water 5 with a kinetic energy not exceeding that which it would have at the end of a non-braked free fall, from at most the height $h_{max}$.

These arrangements may be implemented in various ways.

In the embodiment illustrated schematically in FIGS. 1A and 1B, the halyard 4 is most advantageously hooked in a fixed manner to the launch site 2 and preferably at a stowage height of the container 1 as shown at P (hooking point of the halyard 4, for example, to the cradle 2). The halyard 4 functionally cooperates at 7 with the container 1. In this example, the functional cooperation means 7 are not fixed to the container 1 itself, and the container 1 is suspended by slings 6 on said functional cooperation means 7; but it is, of course, conceivable to design appropriate means 7 fixed to the container 1 itself.

In the variant of FIG. 1A, the length of the halyard 4 is approximately the same distance as the height H or at least equal to this height, such that the halyard 4 hangs freely as far as the surface of the water 5. In these conditions, the container 1 is braked over its entire drop height H.

In the variant of FIG. 1B and which constitutes a preferred variant, the halyard 4 is provided with a length L less than the height H, but at least equal to the value $H-h_{max}$, such that the lower end 8 of the halyard hangs freely above the water at a height which does not exceed the aforementioned nominal launch height $h_{max}$ for which the container has been designed.

In these conditions, once released, the container 1 starts by falling by gravity along the halyard 4 with the braking effect produced by the functional cooperation means 7 to which the container 1 is hooked by means of slings 6; then, once the container has reached the free end 8 of the halyard, it finishes by falling in free fall as far as the water from a height which does not exceed $h_{max}$.

This preferred variant is particularly interesting as it allows the fall characteristics normally anticipated for the container (drop height $h_{max}$) to be exploited, whilst providing the halyard 4 only with the length L necessary to move the container in a braked manner to the position where it may be released. This results in a saving in the cost of the halyard.

A second embodiment of the arrangements of the invention is illustrated in FIG. 2 which is distinguished from the embodiment of FIGS. 1A and 1B by the fact that here the halyard 4 is fixedly hooked at its lower end to the container 1, for example by means of slings 6 and that the halyard 4 functionally cooperates at 7 with the launch site 2, in other words that the functional cooperation means 7 are arranged at the launch site 2 (for example attached to the cradle 2 approximately at the stowage height of the container 1). Thus in this example, the halyard 4 is not fixed but accompanies the container 1 in its fall (the portion of the halyard 4 upstream of the means 7 is denoted by the reference numeral 4*a* and is, for example, wound up or coiled—the container 1 being assumed to be shown during its fall).

If the length of the halyard 4 is at least equal to the height H, it will unwind through the means 7 and accompany the container 1 over its entire drop height and the container 1 will be braked over the entire length of its fall until its contact with the surface of the water 5 in the same conditions as have been illustrated in FIG. 1A.

If the length L of the halyard 4 is less than the height H but greater than the height $h_{max}$, the container 1 will firstly fall whilst being braked by the halyard 4, then will finish in free fall, in the same conditions as those which have been illustrated in FIG. 1B.

Due to the arrangements according to the invention, it is possible to standardize the life raft containers with which the whole ship or a fixed installation is equipped. More specifically, all the containers may therefore be selected of the type intended to be arranged in the lower part of the installation or the lower deck of the ship, namely of the type having the lowest mechanical resistance. Regarding containers which have to be installed on the decks or intermediate or upper areas, they are selected from the same type as the aforementioned containers and a halyard having the required length is functionally associated therewith which makes it possible to ensure that they are put into the water from the nominal height for which they have been designed and approved. Due to this standardization, it therefore becomes possible to reduce the overall cost of equipping the ship or fixed installation with life-saving equipment.

To provide the functional cooperation means 7 with a braking effect, a plurality of practical solutions are conceivable.

A first solution consists in generating a braking or deceleration effect by successive ruptures of a multiplicity of rupturable members designed to this effect.

Figure 3:
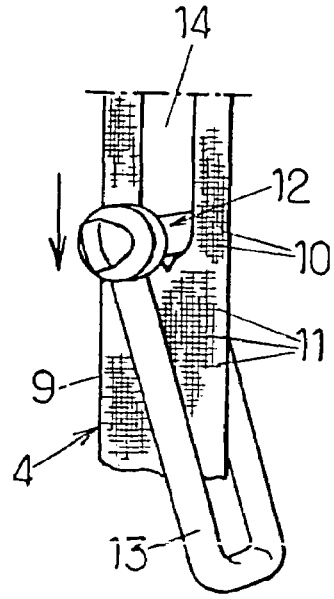
FIG. 3 is a sketch illustrating an embodiment of braking means capable of being implemented within the scope of the invention.
Figure 4:
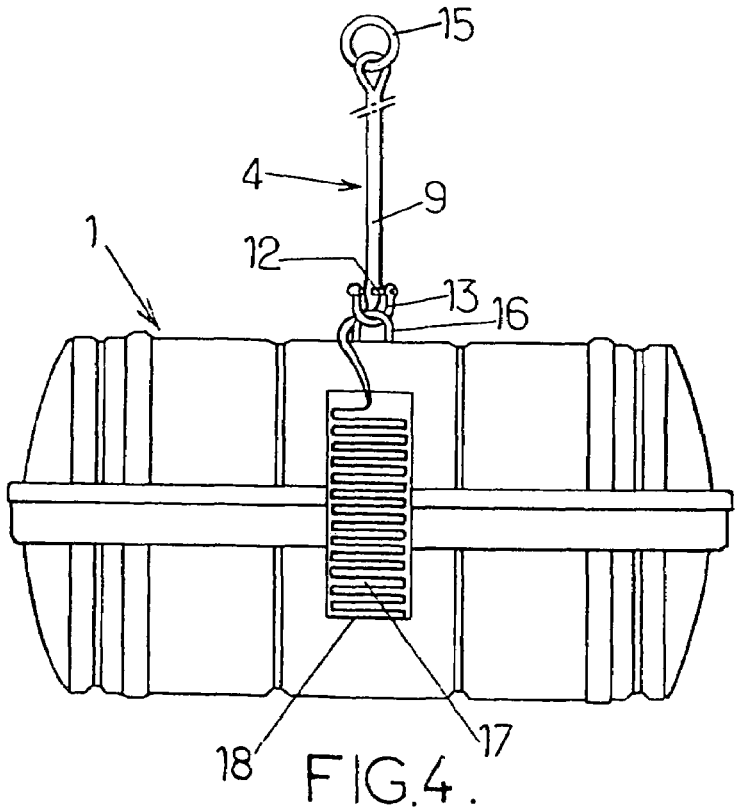
FIG. 4 is a schematic view of a container containing a life raft which is designed according to the invention with the means of FIG. 3.

An embodiment illustrated in FIG. 3 refers to a process of longitudinal splitting or tearing of a tubular strap 9 forming the aforementioned halyard 4. The tubular strap 9 is composed of very resistant longitudinal threads 10 extending over its entire length and woven with one another by means of transverse threads 11 (or zones of transverse threads) of lower resistance. It suffices, therefore, for the strap to be penetrated at its centre, by a transverse tearing member 12 which is attached to the container 1 containing the raft. The tearing member 12 may be of any appropriate type, for example a flexible member such as a resistant cord or a rigid, in particular metal, member, such as preferably, as illustrated in FIG. 3, the shackle screw of a shackle 13 attached to the container 1. As shown in FIG. 4, the upper end of the strap 9 is connected to a fixed point in the region of the stowage of the container; for example the end of the strap 9 terminates by a shackle 15 fixed to the hooking point P provided on the launch site (cradle) 2 and engaged in an anchoring point, for example a chain plate 16 fixed to the container 1. In the example illustrated, a single strap 9 is provided and the chain plate 16 is arranged in the center of the container. When dropped, the weight of the container 1 is applied, by means of the shackle 13 and the shackle screw 12, to the woven transverse threads 11 of the strap 9 which, being insufficiently resistant, break in succession and the shackle 13 moves down along the strap causing splitting (at 14) thereof. The successive ruptures of the transverse threads 11 result in slowing down or braking the fall of the container. To avoid any risk of knot formation or catching the lower part of the strap 9 (namely the part extending under the container 1), it is preferable not to allow this part to hang freely as illustrated in FIGS. 1A and 1B, but to coil it (as shown clearly at 17 in FIG. 4) in a pocket 18 fixed to the container 1 and outside of which pocket it may unwind freely.

The braking of the container is directly associated with the weight thereof: the greater the weight to be braked, the higher the resistance to splitting the strap 9 has to have. This resistance to splitting may be increased:

- by increasing the inherent resistance of the transverse woven threads of the strap,
- by increasing the number of transverse woven threads of the strap,
- by increasing the number of straps penetrated by the shackle,
- by increasing the number of straps and anchoring points on the container,
- by combining the braking process by means of splitting the strap, with one or more other braking means.

Figure 5:
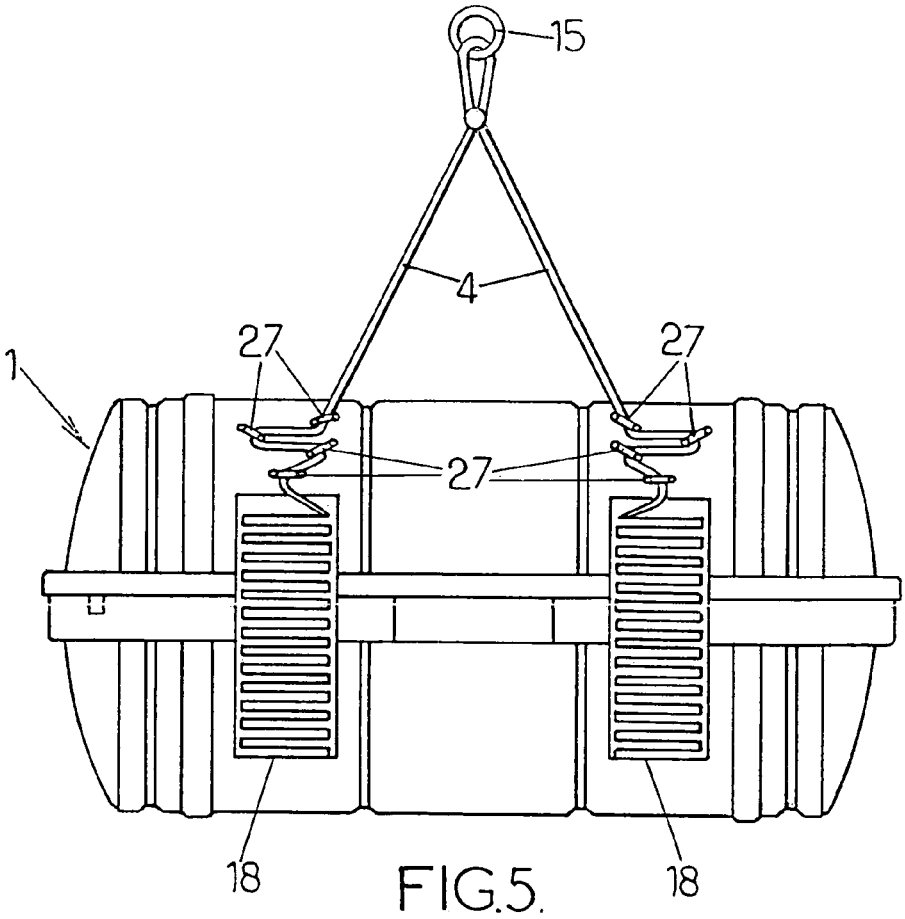
FIG. 5 illustrates schematically, in a side view, a container containing a life raft which is designed according to the invention with a further embodiment of the braking means.

A further conceivable solution consists in generating the desired braking effect by the friction produced by the sliding of the halyard 4 through a member fixed to the container 1. For example, the halyard 4 may be slid in a system of staggered passages provided on the container 1. To this end, as illustrated in FIG. 5, the container 1 may be equipped with passage points which may, for example, be constituted by chain plates 27 staggered according to a precise configuration and passed through one after the other by the halyard 4. The upper end of the halyard 4 is fixed, for example by a shackle 15, to a fixed hooking point; its lower part is housed, coiled, in a pocket 18 fixed to the container 1. FIG. 5 illustrates a double arrangement. When the container 1 is dropped, the friction of the halyard 4 in the chain plates 27 generates a braking effect which is commensurate with the relative orientation of the halyard and each chain plate, the passage section of each chain plate and the number of these chain plates, in other words the number of friction points. Numerous variants are possible.

Figure 6:
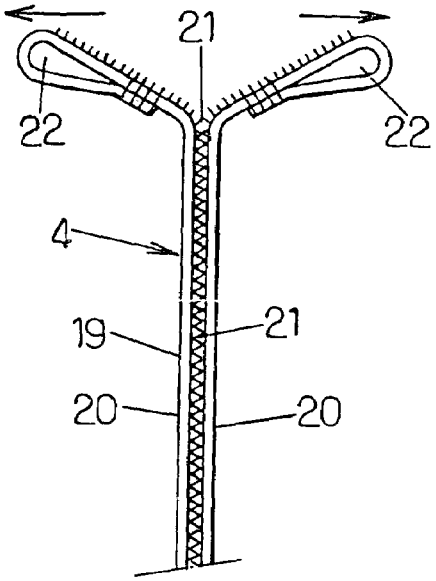
FIG. 6 is a schematic view further illustrating another embodiment which is preferred, of braking means, shown in side view, capable of being implemented within the scope of the invention.

A further embodiment, which in practice is easier to control and which currently appears to constitute the preferred embodiment of the invention, refers to a process of tearing a halyard 4 in the form of a double strap 19 which, as illustrated in FIG. 6, is made up of two basic straps 20 connected to one another by binding threads 21. This connection may be carried out directly during the weaving of the straps 20 or, preferably, the two straps 20 are sewn to one another. The resistance to rupture of a halyard 4 thus formed depends, in particular, on the resistance and the density of the connecting threads 21.

Figure 7:
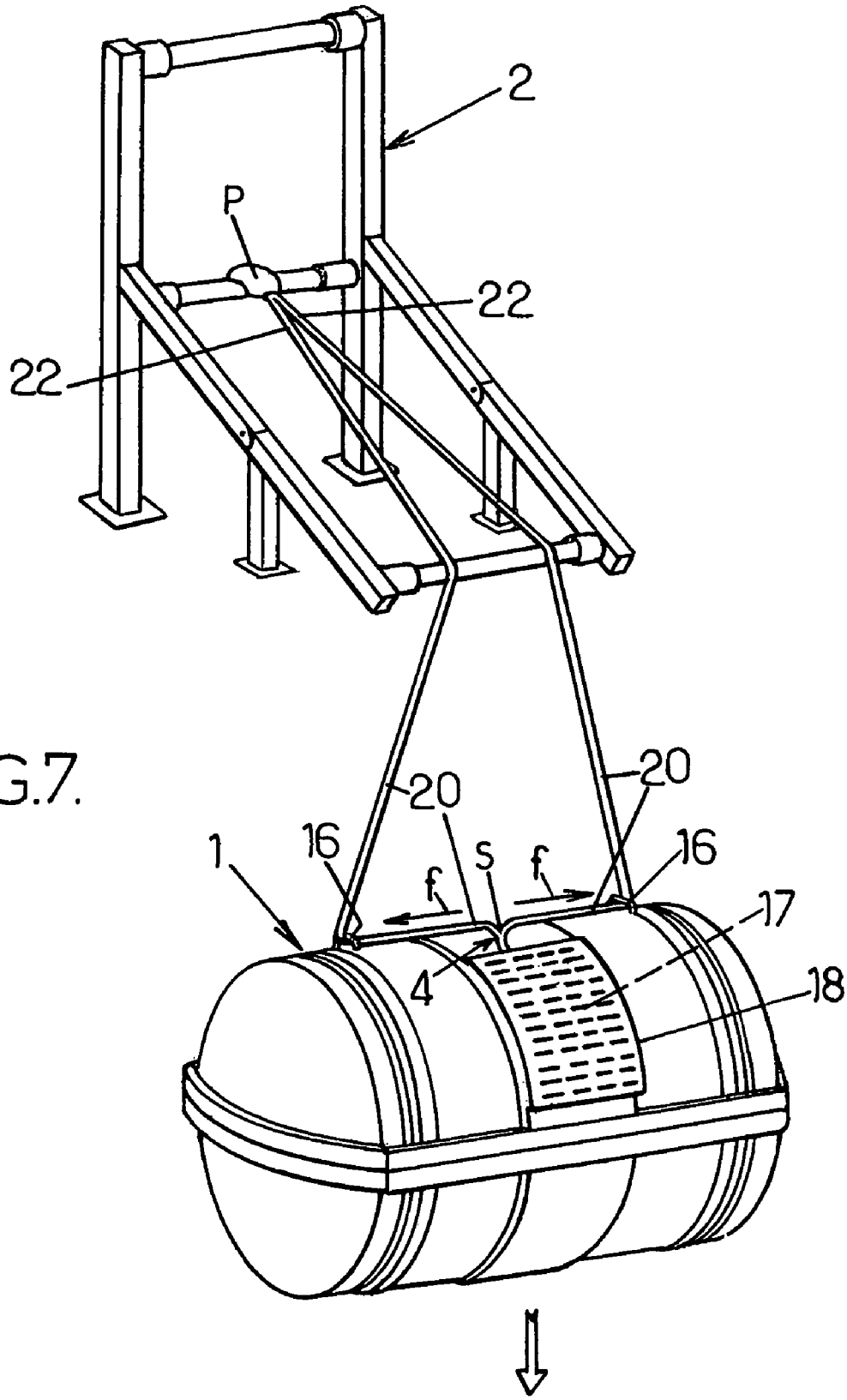
FIG. 7 illustrates a set of life-saving equipment comprising a support cradle for a container containing a life raft and such a container which are designed according to the invention with the means of FIG. 6.

In this case, the container 1 may be fitted out in a preferred manner as shown in FIG. 7. The halyard 4 is coiled (at 17) and stowed in a pocket 18 fixed to the container 1. At the free end of the halyard 4, the ends of the two straps 20 are separated from one another and are respectively engaged through two chain plates 16 provided on the container 1, whilst being remote from one another. The two loops 22 respectively terminating the two straps 20 are hooked, possibly by means of shackles at P, to an element of the cradle 2. As shown in FIG. 7, when the container 1 is dropped, under the action of the weight of the container 1, the two basic straps 20 are pulled apart from one another (arrows f), extending substantially in the extension of one another from their point of separation S; the connecting threads 21 having an appropriate resistance with regard to this weight, break successively and progressively over the entire length of the halyard 4 (the point of separation S thus continuing along the halyard 4) producing the required braking effect. Due to this arrangement, the container is suspended in a balanced manner and moves down in a braked manner, approximately maintaining its initial position.

It will be noted that it would be possible to adopt the reverse solution, with the ends of the straps separated from one another attached to the container and the chain plates arranged on the cradle, the pocket containing the halyard being associated therewith. Nevertheless, the solution disclosed above regarding FIG. 7. is preferable, as at the end of the operation the container is separated from the halyard which remains hooked to the cradle and which does not then hinder the process of opening the container.

Figure 8:
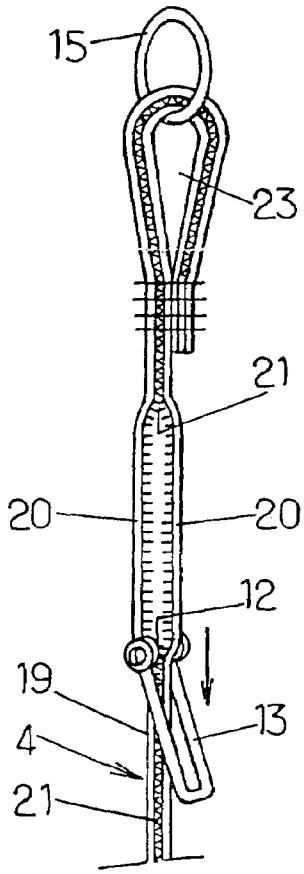
FIG. 8 is a schematic view illustrating a variant of the means of FIG. 6.

In a possible variant illustrated in FIG. 8, a splitting member 12 (for example the shackle screw 12 of a shackle 13 for hooking to a chain plate of the container 1) is added to the halyard 4. The shackle 12 is engaged through the connecting threads 21 between the two basic straps 20, in the vicinity of the upper end of the halyard 4 shaped in a loop 23 engaged in a hook shackle 15. When the container 1 is dropped, the shackle 12 under the action of the weight of the container, successively tears all the connecting threads 21 by a splitting action.

Figure 9:
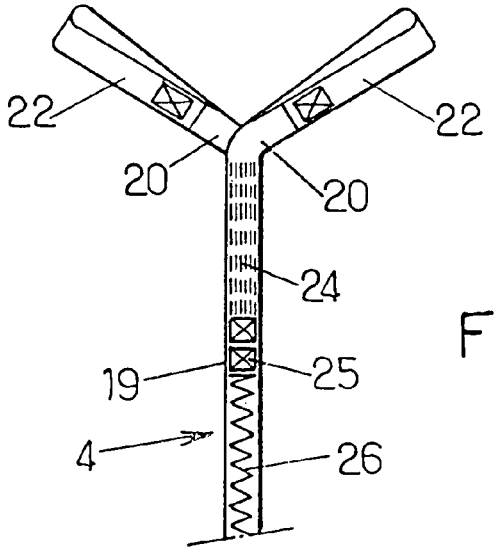
FIG. 9 is a schematic view illustrating, in front view, various possible solutions for practical implementation of the means of FIG. 6.

The resistance of the stitching of the double strap 19 is selected according to the weight of the container to be braked and the speed to be attained upon impact of the container with the surface of the water. The resistance of the stitching depends on the resistance of the thread used, the number of stitching points per surface unit of the straps 20, the geometry of the stitching lines and the frequency of the stop points. So as not to increase the number of drawings, FIG. 9 shows, in front view, the double strap 19 of FIG. 6 with three possible examples of stitching—successively from top to bottom, stitching 24 in parallel longitudinal lines, stitching 25 in squares/rectangles with diagonals, stitching 26 in a zigzag.

By way of example, two straps available commercially may be used with the reference PY L22 undyed, having a nominal width of 22 mm, a nominal thickness of 1.5 mm and a nominal resistance of 1000 daN and which are sewn to one another with the polyester thread Saphyr ER 16/3 of 190 tex, having a diameter of 0.49 mm and a resistance of 9.8N. The two straps are connected by 6 lines of parallel stitching, with 4 stitching points per 12 mm. A braking halyard constituted by a strap produced in this manner is capable of braking a container of a weight in the order of 130 to 170 kg, in the targeted conditions within the scope of the invention.

If it is necessary, in particular, to handle a greater weight than that allowable for an individual halyard, the appropriate braking force may be obtained by using a plurality of halyards in parallel. It is also possible to combine a plurality of means explained above, when such a combination is technically possible. Furthermore, on the launch site, it is possible to position the aforementioned braking means on the container or in association therewith, and vice versa.

What is claimed is:

1. A method for launching into the water, from a height H greater than a predetermined height $h_{max}$, a life-saving means which is designed to be able to be launched into the water in free fall from said maximum height $h_{max}$, wherein at least one halyard is fixedly hooked by one of its ends to the life-saving means or to the launch site located at said height H, wherein the length of the halyard is less than the height H, but at least equal to $(H-h_{max})$, wherein the halyard is a woven or sewn or stitched halyard having transverse calibrated rupture threads, and wherein the successive rupture of these transverse threads under the action of the weight of the life-saving means produces a braking effect, so that the life-saving means falling by gravity is braked on and/or by the halyard over at least one part $(H-h_{max})$ of its drop height, and whereby the life-saving means falls whilst being braked over the entire length of the halyard and then falls in free fall over a height not exceeding $h_{max}$ in such a manner that the life-saving means hits the surface of the water with a kinetic energy not exceeding that which it would have at the end of a non-braked free fall from at most the height $h_{max}$.

2. The method according to claim 1, wherein one lower end of the halyard is fixedly attached to the life-saving means and wherein the halyard functionally cooperates with the launch site.

3. The method according to claim 2, wherein to create said functional cooperation, a halyard formed from at least two straps sewn or stitched to one another by calibrated rupture threads is used, wherein the respective ends of these two straps belonging to the same end of the halyard are fixedly attached to the launch site, and wherein these calibrated rupture threads are successively and progressively broken as the life-saving means falls, whereby it is the rupture of the threads due to the force of separation applied to the straps by the weight of the life-saving means which produces the braking effect.

4. The method according to claim 1, wherein one upper end of the halyard is fixedly attached to the launch site and wherein the halyard functionally cooperates with the life-saving means.

5. The method according to claim 4, wherein to create said functional cooperation, a halyard formed from at least two straps sewn or stitched to one another by calibrated rupture threads is used, wherein the respective ends of these two straps belonging to the same end of the halyard are fixedly attached to the life-saving means, and wherein these calibrated rupture threads are successively and progressively broken as the life-saving means falls, whereby it is the rupture of the threads due to the force of separation applied to the straps by the weight of the life-saving means which produces the braking effect.

6. A device allowing a life-saving means which is designed to be able to be launched into the water in free fall from said maximum height $h_{max}$, to be launched into the water from a height H greater than a predetermined height $h_{max}$, comprising at least one halyard and:

wherein the halyard is configured for being fixedly hooked to the life-saving means or to the launch site located at said height H, wherein the length of the halyard is less than the height H, but at least equal to $(H-h_{max})$, and wherein connecting means combining said halyard respectively to said launch site or to said life-saving means are formed by the halyard being a woven or stitched or sewn halyard, with transverse calibrated rupture threads, whereby the successive rupture of these transverse threads under the action of the weight of the life-saving means produces a braking effect such that, when the life-saving means is released from the launch site and falls under the action of gravity, it is braked on and/or by means of the halyard over at least one part $(H-h_{max})$ of its drop height, whereby the life-saving means falls whilst being braked over the entire length of the halyard, and then falls in free fall over a height not exceeding $h_{max}$ in such a manner that the life-saving means finally hits the surface of the water with a kinetic energy which does not exceed that which it would have at the end of a free fall from a height of at most $h_{max}$.

7. The device according to claim 6, comprising a multiplicity of members with calibrated passages capable of being passed through by the halyard which are provided on the life-saving means or on the launch site and which are arranged so as to define a winding trajectory for the halyard, whereby the braking effect is produced by the friction of the halyard sliding in said calibrated passages as the life-saving means falls.

8. The device according to claim 6, wherein one lower end of the halyard is fixedly attached to the life-saving means and in that said connecting means functionally connect the halyard to the launch site.

9. The device according to claim 6, wherein one upper end of the halyard is fixedly attached to the launch site and wherein said connecting means functionally connect the halyard to the life-saving means.

10. The device according to claim 6, wherein the halyard comprises at least two straps sewn or stitched to one another by calibrated rupture threads, whereby it is the successive and progressive rupture of these sewn or stitched threads under the action of the weight of the life-saving means which produces the braking effect.

11. The device according to claim 6, wherein the halyard comprises at least two straps sewn or stitched to one another by calibrated rupture threads, and wherein the two respective ends of the two straps separated from one another are engaged through two guides remote from one another, of the life-saving means and are fixedly hooked to the launch site, whereby it is the successive and progressive rupture of these sewn or stitched threads under the action of the weight of the life-saving means which produces the braking effect and whereby the two straps are pulled in opposite directions to one another under the action of the weight of the life-saving means, producing the successive and progressive rupture of the sewn or stitched threads.

12. The device according to claim 6, wherein the life-saving means is a container containing an uninflated and folded inflatable life raft.

* * * * *